US011408265B2

(12) United States Patent
El Mahbes et al.

(10) Patent No.: US 11,408,265 B2
(45) Date of Patent: Aug. 9, 2022

(54) DOWNHOLE PUMPING SYSTEM WITH VELOCITY TUBE AND MULTIPHASE DIVERTER

(71) Applicant: Baker Hughes Oilfield Operations LLC, Houston, TX (US)

(72) Inventors: Reda El Mahbes, Houston, TX (US); Leslie Reid, Coweta, OK (US); Partha Ganguly, Sugarland, TX (US); Ronald McPhearson, Spring, TX (US)

(73) Assignee: Baker Hughes Oilfield Operations, LLC, Houston, TX (US)

( * ) Notice: Subject to any disclaimer, the term of this patent is extended or adjusted under 35 U.S.C. 154(b) by 0 days.

(21) Appl. No.: 15/930,411

(22) Filed: May 12, 2020

(65) Prior Publication Data

US 2020/0362683 A1 Nov. 19, 2020

Related U.S. Application Data

(60) Provisional application No. 62/847,267, filed on May 13, 2019.

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01); *E21B 2200/09* (2020.05)

(58) Field of Classification Search
CPC ..... E21B 43/38; E21B 43/121; E21B 2200/09
See application file for complete search history.

(56) References Cited

U.S. PATENT DOCUMENTS

| | | | | |
|---|---|---|---|---|
| 3,986,552 | A | 10/1976 | Scott | |
| 5,433,269 | A | 7/1995 | Hendrickson | |
| 5,553,669 | A * | 9/1996 | Trainer | B01D 29/114 166/105.1 |
| 5,660,533 | A | 8/1997 | Cartwright | |
| 6,126,416 | A | 10/2000 | Lee | |
| 6,186,227 | B1 | 2/2001 | Vaynshteyn et al. | |
| 6,315,050 | B2 | 11/2001 | Vaynshteyn et al. | |
| 6,564,876 | B2 | 5/2003 | Vaynshteyn et al. | |
| 6,899,176 | B2 | 5/2005 | Hailey et al. | |
| 7,387,158 | B2 | 6/2008 | Murray et al. | |
| 7,552,777 | B2 | 6/2009 | Murray et al. | |
| 8,322,450 | B2 | 12/2012 | Meijer | |
| 8,998,586 | B2 | 4/2015 | Muhs | |

(Continued)

FOREIGN PATENT DOCUMENTS

WO 2012169904 A2 12/2012

OTHER PUBLICATIONS

ISA/US; Search Report and Written Opinion; PCT/US2020/032546; dated Jul. 30, 2020.

*Primary Examiner* — David Carroll
(74) *Attorney, Agent, or Firm* — Crowe & Dunlevy, P.C.

(57) ABSTRACT

A pumping system is configured to be deployed in a well that has a vertical portion and a lateral portion. The pumping system includes a pump positioned in the vertical portion, a velocity tube assembly that extends from the vertical portion into the lateral portion and a multiphase diverter connected between the pump and the velocity tube assembly. The multiphase diverter includes a housing and a plurality of ejection ports that extend through the housing at a downward angle.

20 Claims, 8 Drawing Sheets

(56) References Cited

U.S. PATENT DOCUMENTS

| | | | | |
|---|---|---|---|---|
| 9,447,661 | B2 | 9/2016 | Broussard et al. | |
| 2002/0023750 | A1 | 2/2002 | Lopes et al. | |
| 2004/0129432 | A1 | 7/2004 | Wills et al. | |
| 2005/0199551 | A1 | 9/2005 | Gordon | |
| 2005/0281683 | A1 | 12/2005 | Brown et al. | |
| 2008/0093085 | A1 | 4/2008 | Knight et al. | |
| 2008/0110614 | A1* | 5/2008 | Orban | E21B 43/128 166/101 |
| 2009/0065202 | A1* | 3/2009 | Brown | E21B 43/38 166/267 |
| 2010/0206732 | A1 | 8/2010 | Hale | |
| 2011/0024119 | A1* | 2/2011 | Wolf | E21B 37/00 166/301 |
| 2012/0057965 | A1 | 3/2012 | Bergamini et al. | |
| 2013/0025865 | A1* | 1/2013 | Knobloch, Jr | E21B 21/12 166/301 |
| 2013/0068455 | A1* | 3/2013 | Brown | E21B 43/128 166/265 |
| 2013/0075105 | A1 | 3/2013 | Morton | |
| 2013/0306330 | A1 | 11/2013 | Bishop et al. | |
| 2014/0332239 | A1 | 11/2014 | Porta | |
| 2015/0053394 | A1 | 2/2015 | Reid et al. | |
| 2015/0098840 | A1 | 4/2015 | Kowalchuk | |
| 2015/0167652 | A1 | 6/2015 | Van et al. | |
| 2015/0204158 | A1 | 7/2015 | Frisby et al. | |
| 2015/0205158 | A1 | 7/2015 | Engel et al. | |
| 2015/0275619 | A1 | 10/2015 | Slup | |
| 2015/0345276 | A1 | 12/2015 | Jensen | |
| 2016/0003031 | A1 | 1/2016 | Xin et al. | |
| 2016/0130919 | A1 | 5/2016 | Vasques | |
| 2016/0222770 | A1 | 8/2016 | Kirk et al. | |
| 2017/0241215 | A1 | 8/2017 | Kleppa | |
| 2017/0342798 | A1 | 11/2017 | Wutherich | |
| 2018/0112509 | A1* | 4/2018 | Saponja | E21B 43/12 |
| 2018/0171763 | A1 | 6/2018 | Malbrel et al. | |
| 2018/0179852 | A1 | 6/2018 | Hou et al. | |
| 2018/0223642 | A1 | 8/2018 | Zahran | |
| 2018/0298736 | A1 | 10/2018 | Bailey et al. | |

* cited by examiner

DOWNHOLE PUMPING SYSTEM WITH VELOCITY TUBE AND MULTIPHASE DIVERTER

RELATED APPLICATIONS

This application claims the benefit of U.S. Provisional Patent Application Ser. No. 62/847,267 filed May 13, 2019 entitled, "Downhole Pumping System with Velocity Tube and Multiphase Diverter," the disclosure of which is herein incorporated by reference.

FIELD OF THE INVENTION

This invention relates generally to the field of oil and gas production, and more particularly to downhole gas and solids separation systems for improving the recovery of oil and gas from a well.

BACKGROUND

Hydrocarbon fluids produced from subterranean wells often include liquids and gases. Although both may be valuable, the multiphase flow may complicate recovery efforts. For example, naturally producing wells with elevated gas fractions may overload phase separators located on the surface. This may cause gas to be entrained in fluid product lines, which can adversely affect downstream storage and processing.

In wells in which artificial lift solutions have been deployed, excess amounts of gas in the wellbore fluid can present problems for downhole equipment that is primarily designed to produce liquid-phase products. In particular, a high gas-to-liquid ratio ("GLR") may adversely impact efforts to recover liquid hydrocarbons with pumping equipment. Gas "slugging" occurs when large pockets of gas are expelled from the producing geologic formation over a short period of time. Free gas entering a downhole rod-lift pump can significantly reduce pumping efficiency and reduce running time. System cycling caused by gas can negatively impact the production as well as the longevity of the system.

Centrifugal pumps are also sensitive to elevated gas ratios. The centrifugal forces exerted by downhole turbomachinery tend to separate gas from liquid, thereby increasing the chances of cavitation or vapor lock. Downhole gas separators have been used to remove gas before the wellbore fluids enter the pump. In operation, wellbore fluid is drawn into the gas separator through an intake. A lift generator provides additional lift to move the wellbore fluid into an agitator. The agitator is typically configured as a rotary paddle that imparts centrifugal force to the wellbore fluid. As the wellbore fluid passes through the agitator, heavier components, such as oil and water, are carried to the outer edge of the agitator blade, while lighter components, such as gas, remain close to the center of the agitator. In this way, modern gas separators take advantage of the relative difference in specific gravities between the various components of the two-phase wellbore fluid to separate gas from liquid. Once separated, the liquid can be directed to the pump assembly and the gas vented from the gas separator.

Although generally effective, these prior art gas downhole gas separators incorporate the use of a driven shaft that may not be present in all certain applications. Additionally, existing gas separation equipment may be ineffective at reducing the concentration of solid particles entrained within the gas and liquid stream. There is, therefore, a need for an improved gas and solid separator system that provides gas and solid separation functionality over an extended range of applications.

SUMMARY OF THE INVENTION

In one aspect, embodiments of the present invention include an encapsulated pumping system is configured to be deployed in a well that has a vertical portion and a lateral portion. The encapsulated pumping system includes an electric submersible pump positioned in the vertical portion, a velocity tube assembly that extends from the vertical portion into the lateral portion and a multiphase diverter connected between the electric submersible pump and the velocity tube assembly. The multiphase diverter includes a housing and a plurality of ejection ports that extend through the housing at a downward angle.

In another aspect, embodiments of the present invention include a pumping system that includes a reciprocating pump positioned in a vertical portion of a well, where the reciprocating pump is actuated by a reciprocating rod string. The reciprocating pump includes a shroud that has an open upper end and a shroud hanger, a standing valve, a traveling valve connected to the reciprocating rod string and an intake tube that extends from the standing valve into the shroud. The pumping system further includes a velocity tube assembly that extends from the vertical portion into a lateral portion of the well, and a multiphase diverter connected between the reciprocating pump and the velocity tube assembly. The multiphase diverter includes a housing and a plurality of ejection ports that extend through the housing at a downward angle.

In yet another embodiment, the present invention includes a pumping system that is configured to be deployed in a well that has a vertical portion and a lateral portion. In this embodiment, the pumping system has an electric submersible pump positioned in the vertical portion, a velocity tube assembly that extends from the vertical portion into the lateral portion, and a multiphase diverter connected between the electric submersible pump and the velocity tube assembly. The pump has a shroud that has an open upper end and a shroud hanger, an electric motor, and a centrifugal pump driven by the electric motor. The multiphase diverter has a housing and a plurality of ejection ports that extend through the housing at a downward angle.

WRITTEN DESCRIPTION

Figure 1:
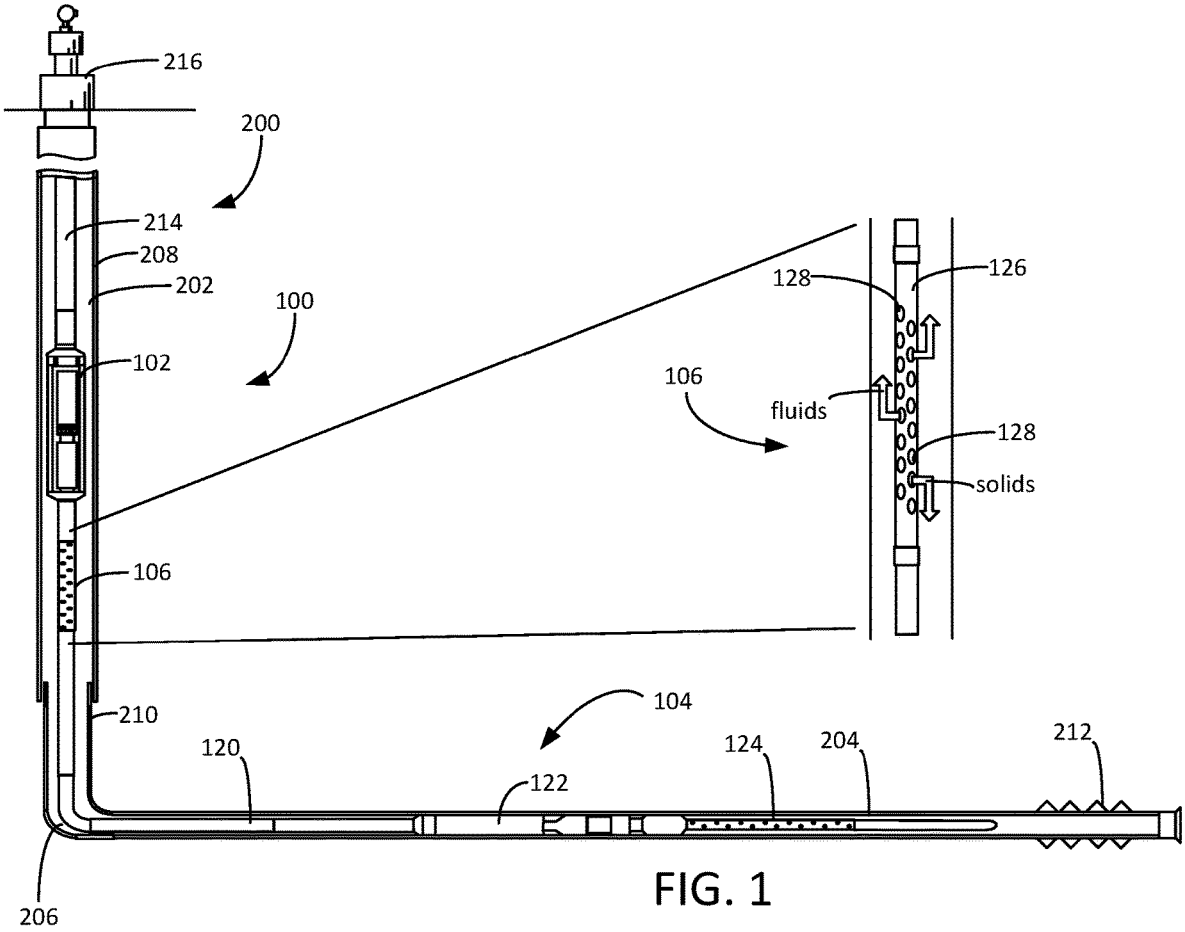
FIG. 1 is a side view of an electric submersible pumping system deployed in a well, showing a close-up view of the velocity tube and multiphase diverter.

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. It will be appreciated by those of skill in the art that in the downhole environment, such fluids may also carry entrained solids and suspensions. Accordingly, as used herein, the terms "two-phase" and "multiphase" are not exclusive of fluids that may also contain liquids, gases, solids, or other intermediary forms of matter.

Referring to FIGS. 1 and 3-8, shown therein are depictions of various embodiments of a pumping system 100 deployed in a well 200 that includes a vertical portion 202, a lateral portion 204, and a heel portion 206 between the vertical portion 202 and the lateral portion 204. The well 200 includes a casing 208 and a production liner 210 connected to the casing 208. The well 200 includes perforations 212 that admit fluids from an adjacent geologic formation into the production liner 210 and well casing 208. Although the well 200 has been depicted as a lateral or deviated well, it will be appreciated that the pumping system 100 can also be deployed in conventional vertical wells and wells that include non-vertical and non-lateral legs. The well 200 includes production tubing 214 that is suspended from a wellhead 216 located on the surface. The production tubing 214 connects the pumping system 100 to the wellhead 216. The wellhead 216 provides a mechanism for throttling or closing the well 200 and for connecting the well 200 to surface separators, storage equipment or downstream processing facilities. It will be appreciated that these drawings are illustrative of the inventive concepts, but are not drawn to scale.

In a first embodiment, the pumping system 100 includes a shrouded or encapsulated electric submersible pump 102, a velocity tube assembly 104 and a multiphase diverter 106. As more clearly indicated in FIG. 3, the electric submersible pump 102 includes a pump 108, a motor 110, a seal section 112 and an inverted shroud 114. The electric submersible pump 102 optionally includes a recirculation tube that diverts a portion of the discharge from the pump 108 to a position near the motor 110 within the shroud 114 to assist in convectively cooling the motor 110 during operation. Although the pumping system 100 is primarily designed to pump petroleum products, it will be understood that the pumping system 100 can also be used to move other fluids. The motor 110 is configured to drive the pump 108. Power is provided to the motor 110 through a power cable (not shown). In some embodiments, the pump 108 is a turbomachine that uses one or more impellers and diffusers to convert mechanical energy into pressure head. In other embodiments, the pump 108 is configured as a positive displacement pump. The pump 108 includes a pump intake that allows fluids from inside the shroud 114 to be drawn into the pump 108. The pump 108 forces the wellbore fluids to the surface through the production tubing 214.

The seal section 112 is positioned above the motor 110 and below the pump 108. The seal section 112 isolates the motor 110 from wellbore fluids in the pump 108, while accommodating the thermal expansion and contraction of lubricants within the motor 110. The seal section 112 may optionally be provided with thrust bearings that mitigate the effects axial thrust produced along the driveline between the motor 110 and the pump 108. Although only one of each component of the electric submersible pump 102 is shown, it will be understood that more can be connected when appropriate, that other arrangements of the components are desirable and that these additional configurations are encompassed within the scope of exemplary embodiments. For example, in many applications, it is desirable to use tandem-motor combinations, gas separators, multiple seal sections, multiple pumps, sensor modules and other downhole components. The shroud 114 functions as a gas mitigation canister and includes an open upper end 116 that admits fluids from the well 200 into the shroud 114. The bottom of the shroud 114 is closed so that all of the fluids admitted to the shroud 114 pass through the open upper end 116. The shroud 114 includes a shroud hanger 118 that secures the shroud 114 to the production tubing 214, while permitting fluids to pass through the shroud hanger 118 into the shroud 114. As best illustrated in the close-up view in FIG. 3, fluids from the well 200 pass within the narrow external annular space between the outside of the shroud 114 and the casing 208 before falling through the open upper end 116 and shroud hanger 118 into the internal annular space between the inside of the shroud 114 and the various components of the electric submersible pump 102. Placing the electric submersible pump 102 below the open upper end 116 of the shroud 114 encourages lighter fluids and gases to continue moving upward through the well 200 while permitting heavier fluids to concentrate inside the shroud 114. In this way, the counter-current flow of denser liquids into the shroud 114 reduces the fraction of gases drawn into the electric submersible pump 102. The shroud 114 is sized to retain a sufficient volume of liquid to allow the electric submersible pump 102 to continue running in the event a large gas slug is encountered in the well 200. In some embodiments, the shroud 114 is configured to provide the electric submersible pump 102 with a fluid reserve of between about 0.25 barrel and 1 barrel under normal operating conditions. If a large gas slug passes through the velocity tube assembly 104 and the multiphase diverter 106, the gas will bypass the shroud 114 and continue moving upward in the well 200, while the electric submersible pump 102 continues to run with the fluid reserve contained within the shroud 114. Once the gas slug has passed, the normal production of fluid into the well 200 will replace the reserve fluid pumped from inside the shroud 114 during the gas slugging event. The length and other dimensions of the shroud 114 can be configured during manufacturing based on the expected slug volume, rate and frequency for the particular well 200 in which the shroud 114 will be installed. A longer shroud 114 will provide a larger buffer to withstand longer gas slugging events. In another embodiment, the shroud 114 does not completely encapsulate the electric submersible pump 102. As illustrated in FIG. 4, the shroud 114 is secured to the electric submersible pump 102 below the intake of the pump 108, but above the motor 110. In this position, the motor 110 is cooled by fluids passing upward through the vertical portion 202 of the well 200, while the position of the pump 108 at the bottom of the shroud 114 ensures that fluid drawn into the pump 108 contains a reduced gas fraction as described above.

Figure 5:
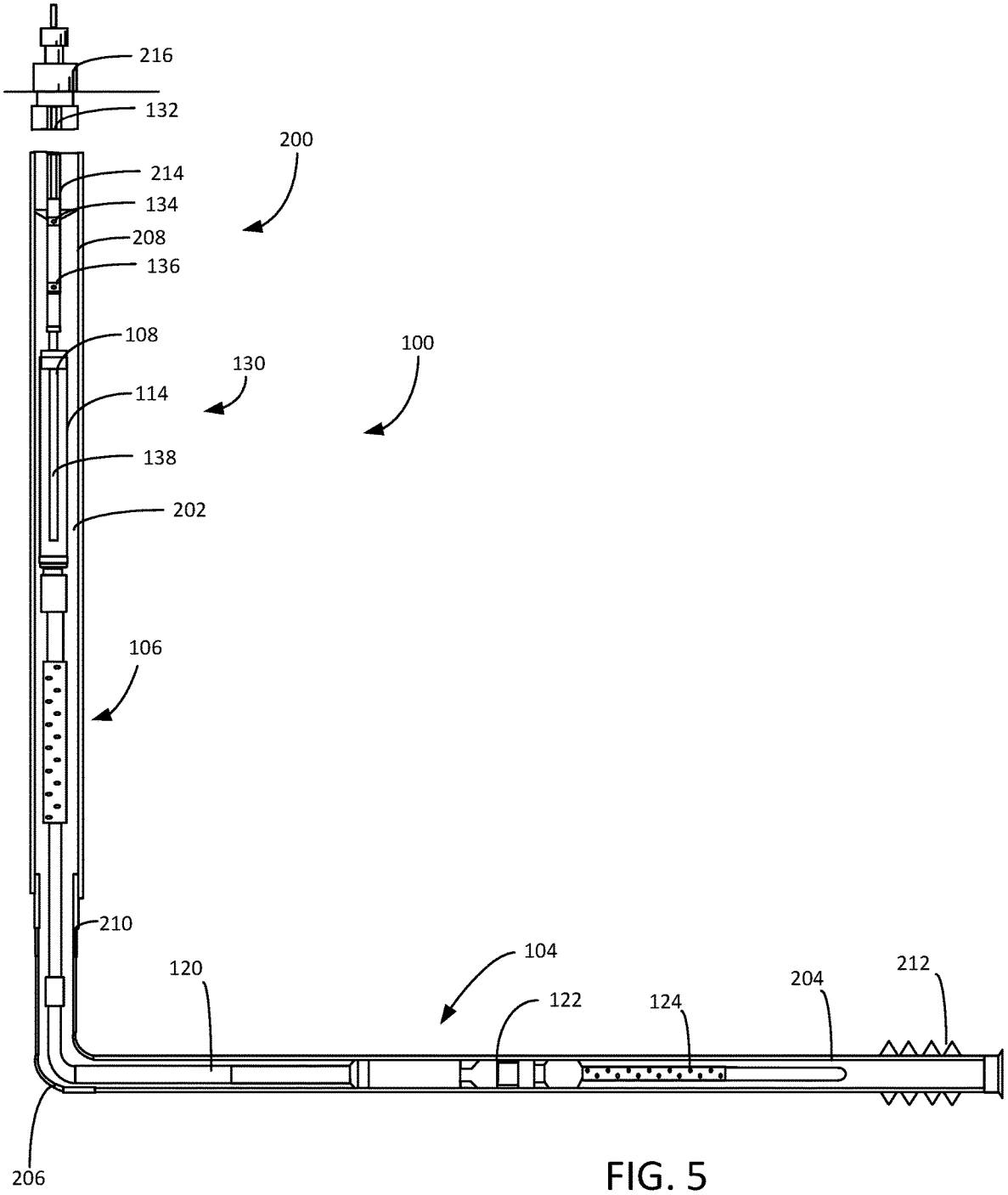
FIG. 5 is a side view of a downhole reciprocating pump deployed with a velocity tube and multiphase diverter.

In yet another embodiment, the velocity tube assembly 104 and multiphase diverter 106 are used in combination with a downhole reciprocating pump 130. As depicted in FIG. 5, the downhole reciprocating pump 130 is positioned in the vertical portion 202 of the casing 208. The reciprocating pump 130 is actuated by a reciprocating rod string 132 that is driven by a surface-mounted rod lift unit (not shown). The reciprocating pump 130 includes a traveling valve 134, a standing valve 136 and an intake tube 138. As depicted in FIG. 5, the reciprocating pump 130 is landed above the shroud 114 and the intake tube 138 extends down into the shroud 114 to supply fluid to the reciprocating pump 130. In other embodiments, the reciprocating pump 130 is landed inside the shroud 114. In yet other embodiments, the standing valve 136 and other stationary components of the reciprocating pump 130 are positioned inside the shroud 114 with the reciprocating components positioned above the shroud 114.

Although the velocity tube assembly 104 and multiphase diverter 106 have been disclosed in connection with a reciprocating pump 130 and an electric submersible pump 102, the use of other downhole pumps in combination with the velocity tube assembly 104 and multiphase diverter 106 are contemplated as additional embodiments. For example, it may be desirable to pair the velocity tube assembly 104 and multiphase diverter 106 with a downhole progressive cavity pump (PCP). The progressive cavity pump can be driven by a submersible motor or by a surface-based motor that transfers torque to the PCP through a rotating rod or linkage.

In the embodiments depicted in FIGS. 1 and 3-5, the velocity tube assembly 104 extends from the vertical portion 202 into the lateral portion 204 of the well 200. The velocity tube assembly 104 includes a velocity string 120, a packer system 122 and an inlet joint 124. The inlet joint 124 is a perforated joint that allows liquids, gases and solids to enter the velocity tube assembly 104. In other embodiments, the inlet joint 124 may include sand or solid exclusion devices that restrict larger particles from entering the velocity tube assembly 104. The relatively narrow inside diameter of the velocity string 120 causes the wellbore fluids to accelerate through the velocity tube assembly 104. Importantly, the velocity tube assembly 104 is designed to maintain the production fluid at or near a critical velocity to maximize drawdown of the well 200.

The packer system 122 includes one or more isolation devices that prevent formation fluids from passing along the outside of the velocity tube assembly 104. In this way, the fluids are forced into the velocity tube assembly 104 through the inlet joint 124. In exemplary embodiments, the packer system 122 includes a tension set packer (not separately designated) that can be retracted from the casing 208 or production liner 210 by releasing tension on the packer system 122. The packer system 122 may also include breakaway joints that allow the pumping system 102 to be disconnected from the velocity tube assembly 104 in the event the velocity tube assembly 104 is jammed in the lateral portion 204 of the well 200.

To minimize the risks of a stuck velocity tube assembly 104, the velocity tube assembly 104 may optionally include a cleanout tool that selectively washes trapped solid particles from around the packer system 122 or other components of the velocity tube assembly 104. One way of activating the cleanout tool is by dropping or pumping a ball or dart from the surface. In another embodiment, the cleanout tool can open discharge ports in response to a signal from the surface or from a service tool. The signal can be wireless, wired or through contact, and may include a variety of signal types including but not limited to acoustic, electric, electromagnetic, RFID, chemical or mechanical (through push, pull or rotational loading). Pumping a wash fluid from the surface through the pumping system 100 to the cleanout tool removes trapped solids around the velocity tube assembly 104 that would otherwise frustrate efforts to remove the pumping system 100 from the well 200.

Figure 2A:
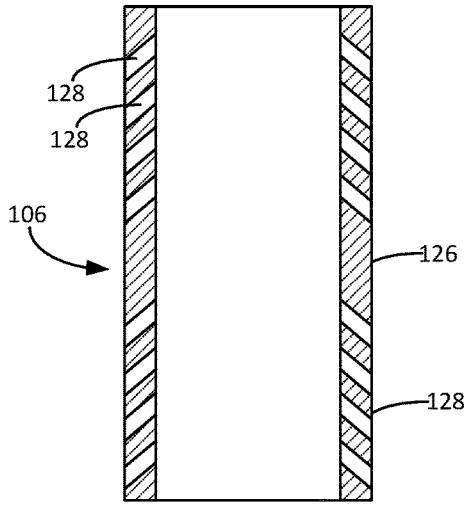
FIGS. 2A and 2B are close-up cross-sectional views of different embodiments of the multiphase diverter from the electric submersible pumping system of FIG. 1.

The velocity string 120 is connected to the multiphase diverter 106, which is in turn connected with a closed joint to the bottom of the shroud 114 in some embodiments or to the motor 110 in other embodiments. The multiphase diverter 106 includes a housing 126 and plurality of ejection ports 128, as best seen in FIGS. 1 and 2, which expel the fluid and solids from the velocity string 120 into the annulus between the casing 208 and the pumping system 100. The ejection ports 128 extend through the housing 126 at a declining angle such that the gases, liquids and solids expelled from the multiphase diverter 106 are forced downward and distributed around the annulus of the well 200. In some embodiments, the ejection ports 128 are angled downward between about 95° and about 175° from a vertical reference axis (as depicted in FIG. 2A). In other embodiments, the ejection ports 128 are angled downward at an angle greater than about 110° from a vertical reference axis. It will be appreciated that the multiphase diverter 106 may include ejection ports 128 of varying diameters and angular orientations.

Figure 2B:
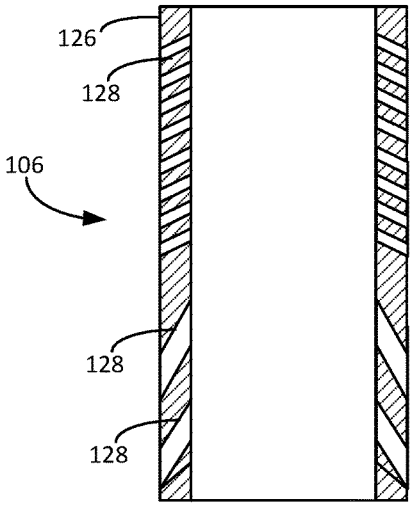

The ejection ports 128 can optionally be configured such that the ejection ports 128 located near the bottom of the multiphase diverter 106 have a larger cross-sectional area than the ejection ports 128 located near the top of the multiphase diverter 106 (as depicted in FIG. 2B). To minimize abrasive damage to the ejection ports 128 caused by the discharge of entrained solids at elevated velocities through smaller ejection ports 128, the multiphase diverter 106 can include a greater number or concentration of the smaller ejection ports 128 near the upper end of the multiphase diverter 106. Thus, in these embodiments, the aggregate cross-sectional area of all of the ejection ports 128 between adjacent portions of the multiphase diverter 106 should be approximately the same.

The shroud 114, velocity string 120 and multiphase diverter 106 each have an outer diameter that provides a tight clearance with respect to the inner diameter of the well casing 208. In some embodiments, the cross-sectional width of the external annular space is between about 2.5% to about 12% of the diameter of the well casing 208. For example, for a 7 inch well casing 208 the shroud 114 can be sized to provide a clearance of between about 0.5 inches to about 0.83 inches. For a 5 inch well casing 208, the shroud 114 can be sized such that it provides a clearance of between about 0.153 inches and 0.38 inches.

Figure 3:
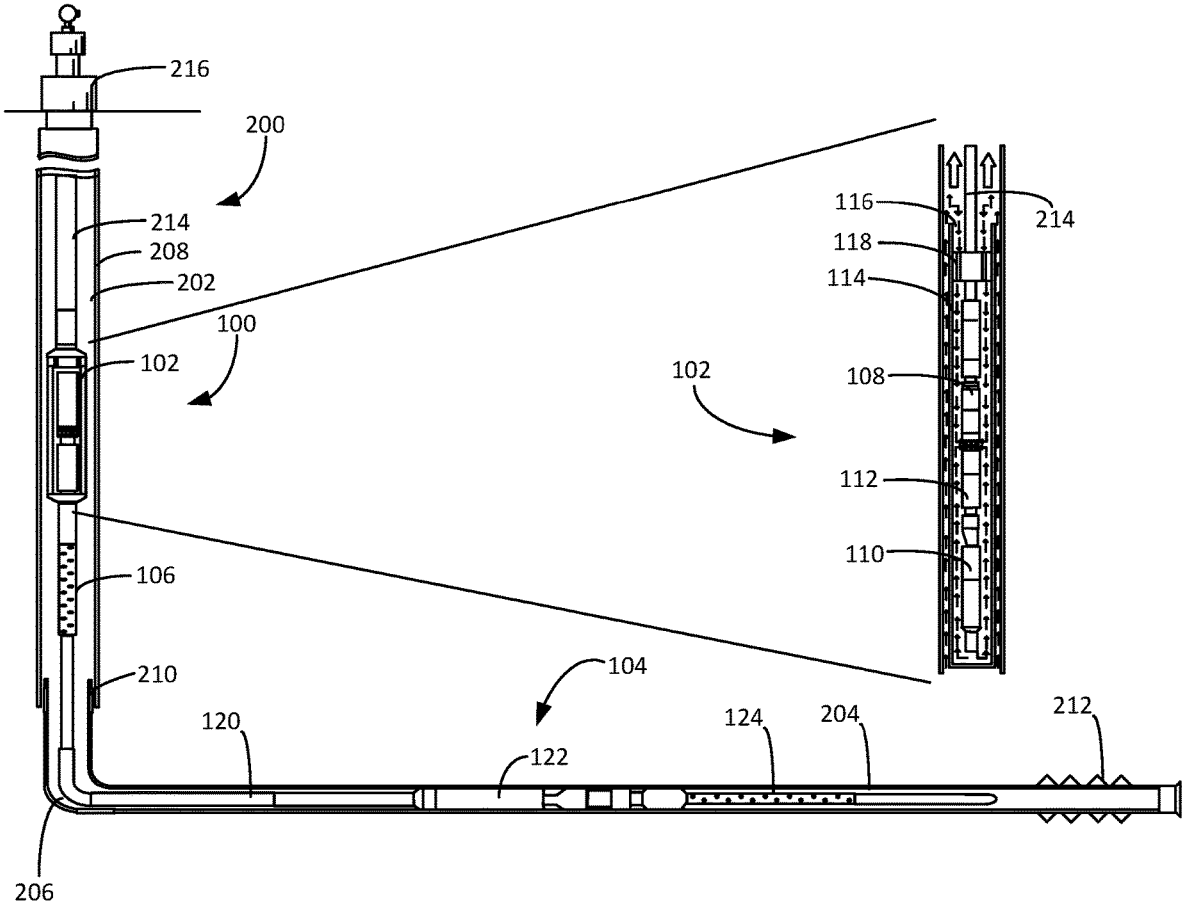
FIG. 3 is a side view of the electric submersible pump system of FIG. 1 with a close-up view of the encapsulated electric submersible pump.
Figure 4:
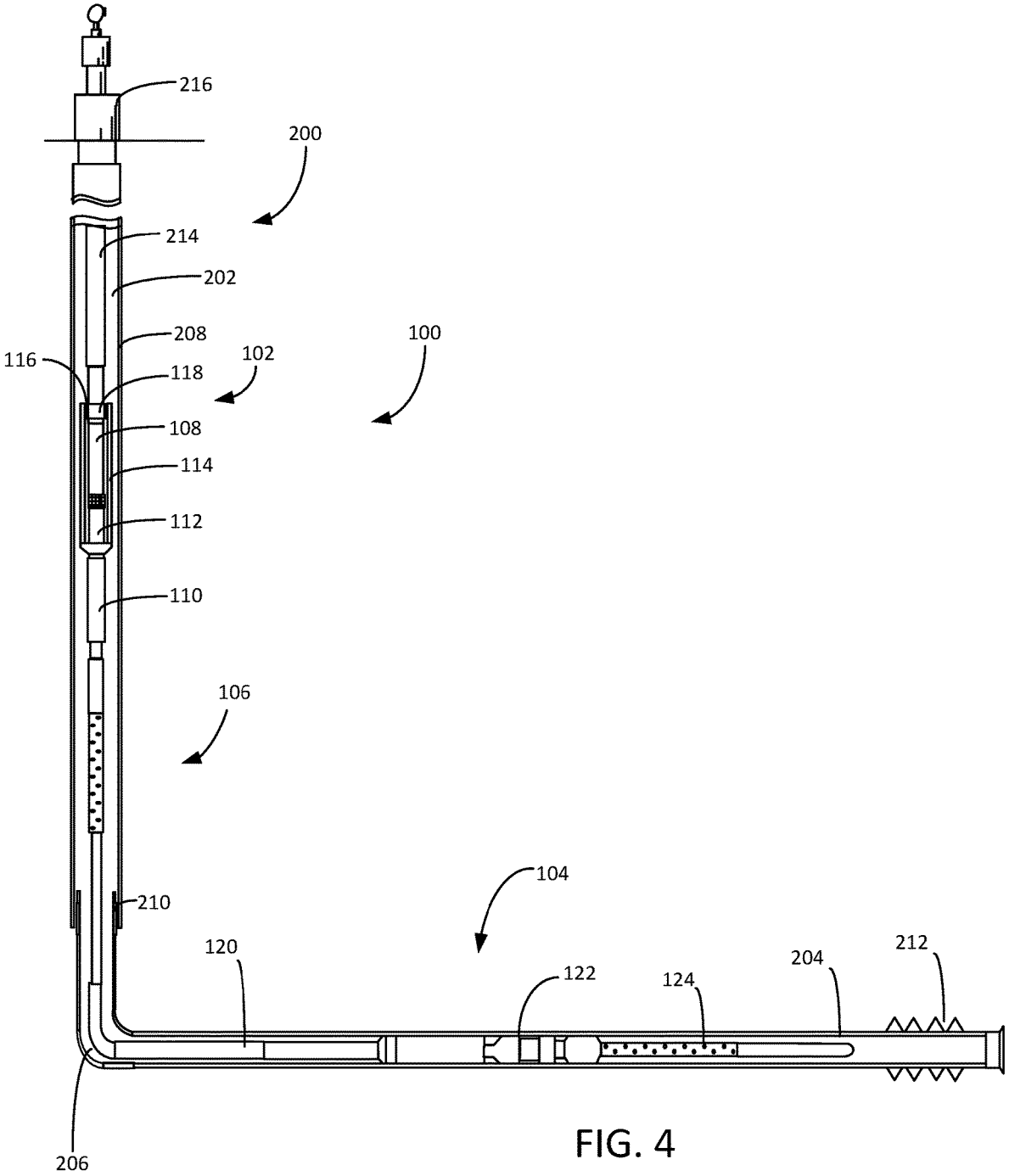
FIG. 4 is a side view of an electric submersible pump system deployed in a well in which the electric submersible pump is partially encapsulated.

As noted in FIGS. 1 and 3, the small external annular space between the shroud 114 and the well casing 208 causes wellbore fluids to accelerate as they pass by the shroud 208. In this way, the pumping system 100 maintains the movement of the fluids at a near critical velocity from the perforations 212 to the electric submersible pump 102 or reciprocating pump 130. A resulting reduction in the pressure of the fluid consistent with Bernoulli's principle assists with the separation of entrained gases from the liquids. Near the top of the shroud 114, the velocity of the liquids and gases rapidly decreases as the cross-sectional area of the annular space between the casing 208 and production tubing 214 increases. As the fluids begin to decelerate, the separated heavier liquid components are encouraged to fall into the shroud through the shroud hanger 118, while the lighter gaseous components continue to rise in the annular space around the production tubing 214.

Figure 6:
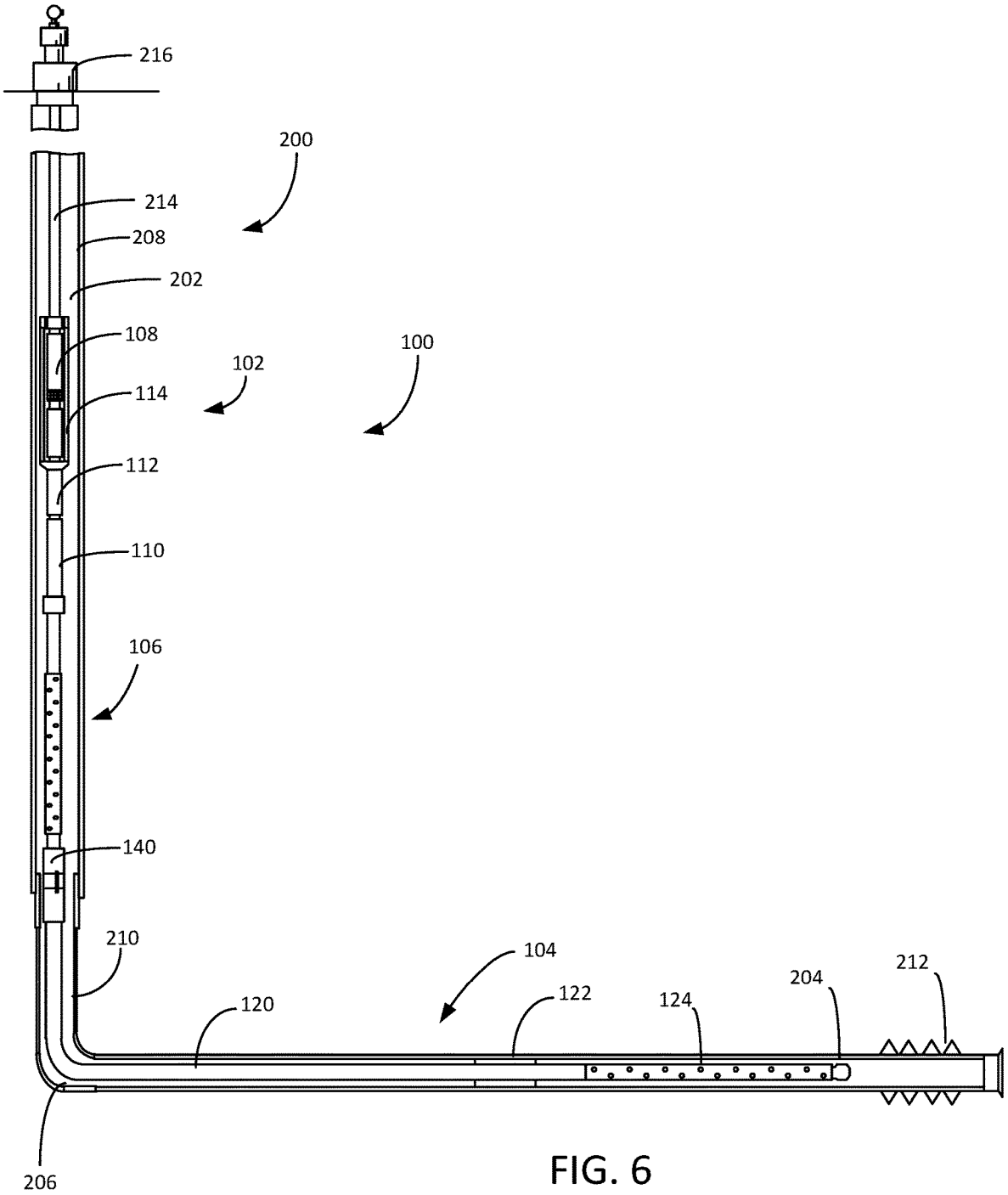
FIG. 6 is a side view of a first pumping system deployed in a well with a disconnect module connected to the velocity string.
Figure 7:
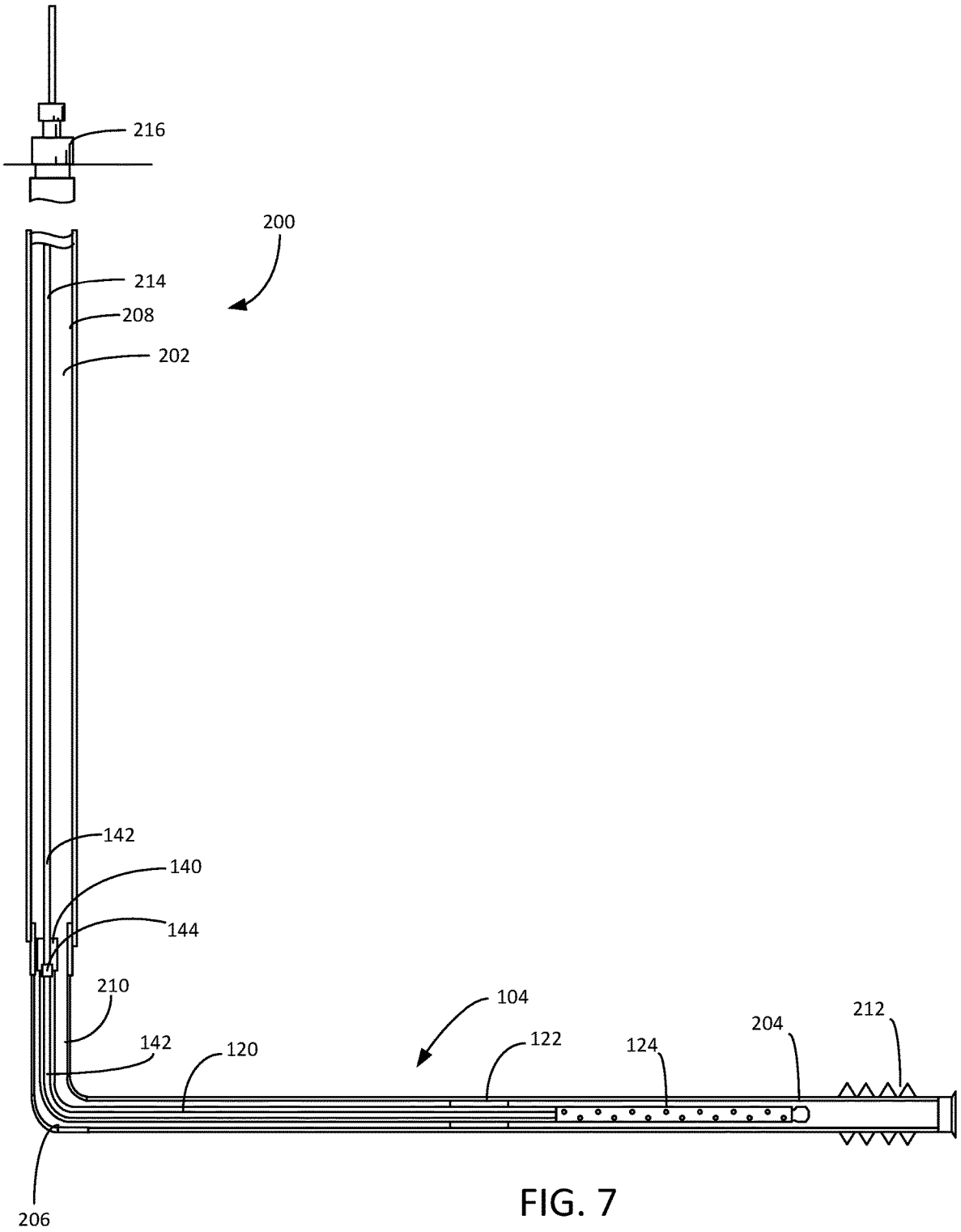
FIG. 7 is a side view of the well of FIG. 6 with the first pumping system removed and an insert tube installed within the velocity string.
Figure 8:
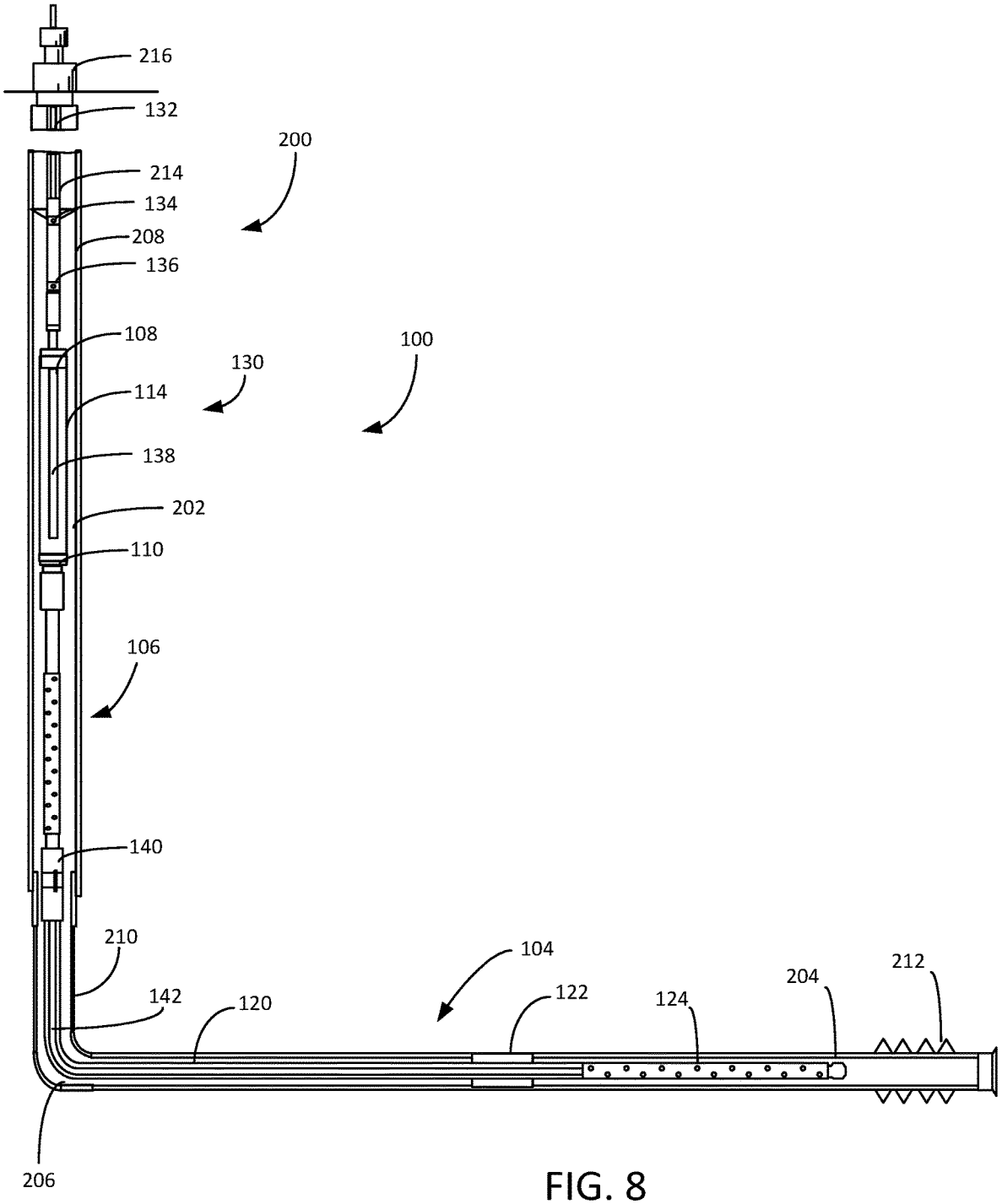
FIG. 8 is a side view of the well of FIG. 7 with a second pumping system installed with the insert tube remaining within the velocity string.

Thus, the velocity tube assembly 104 and multiphase diverter 106 cooperate with the inverted shroud 114 to minimize the presence of gases and solids at the electric submersible pump 102 and reciprocating pump 130. The pumping system 100 is designed such that these elements cooperate to maintain the fluids at a relatively high velocity to maximize drawdown of the well 200 while reducing the presence of solids and gases that are drawn into the electric submersible pump 102 or reciprocating pump 130. Turning to FIGS. 6-8, shown therein are additional embodiments in which the pumping system 100 and velocity tube assembly 104. In these embodiments, a first pump can be replaced by a second pump to address a change in the volume of fluids entering the well 200 from the perforations 212. At the same time, the velocity tube assembly 104 can also be modified to address the changing volumes produced by the well 200.

As illustrated in FIG. 6, the pumping system 100 is provided with a disconnect module 140 positioned between the multiphase diverter 106 and the velocity tube assembly 104. The disconnect module 140 is configured to permit the disconnection and removal of the pumping system 100 and multiphase diverter 106, while the velocity tube assembly 104 remains in the well 200. Suitable disconnect modules 140 are available from Baker Hughes Company, including the "ST-2 On/Off Tool." The disconnect module 140 is a tubing string releasing and retrieving tool that can be used to land and retrieve tubing strings and other components within the well 200.

In this embodiment, the first pumping system 100 depicted in FIG. 6 includes the electric submersible pump 102 that is designed to recover petroleum products while the well 200 is producing higher volumes of fluids. As the production curve for the well 200 declines, the electric submersible pump 102 may no longer represent the most efficient pumping solution for the well 200. In these circumstances, it is desirable to replace the electric submersible pump 102 with a more appropriate solution, such as the downhole reciprocating pump 130.

To replace the electric submersible pump 102, the disconnect module 140 is activated to permit the retrieval of the electric submersible pump 102 and multiphase diverter 106 from the well 200, as depicted in FIG. 7. In FIG. 7, the electric submersible pump 102 and multiphase diverter 106 have been removed from the well 200, leaving the lower portion of the disconnect module 140 connected to the upper end of the velocity tube assembly 104.

To further adapt the pumping system 100 to the lower production volumes, a tubing insert 142 can be inserted into the velocity tube assembly 104 through the remaining portion of the disconnect module 140. The tubing insert 142 is a flexible tubing or coiled tubing that can be injected from the surface through the disconnect module 140 into the velocity tube assembly 104. Installing the tubing insert 142 within the velocity tube assembly 104 creates a smaller annular space within the velocity string 120 that reduces the cross-sectional area available for fluid flow. This increases the velocity of fluids passing through the annular space between the tubing insert 142 and velocity string 120. The outer diameter of the tubing insert 142 can be selected to create an annular passage within the velocity string 120 to maximize the critical velocity of fluid produced through the velocity tube assembly 104.

The tubing insert 142 can include a release joint 144 that permits the portion of the tubing insert 142 above the velocity tube assembly 104 to be disconnected and removed from the well 200. The release joint 142 can be provided with a threaded interface that allows the upper portion of the tubing insert 142 to be unthreaded from the release joint 142 by rotating the tubing insert 142 in the appropriate rotational direction. Once the upper portion of the tubing insert 142 has been retrieved from the well 200, the second pumping system 100 can be installed, as depicted in FIG. 8.

In FIG. 8, the second pumping system 100 is a downhole reciprocating pump 130 that has been installed with the multiphase diverter 106 onto the disconnect module 140. The lower portion of the tubing insert 142 remains in the velocity tube assembly 104. The downhole reciprocating pump 130 can then be operated to maximize the drawdown of the well 200, as outlined above with reference to FIG. 5. It will be appreciated that the presence of the tubing insert 142 within the velocity tube assembly 104 helps to maintain the critical velocity of the wellbore fluids from the perforations 212 to the reciprocating pump 130. If the second pumping system 100 is installed with the disconnect module 140, the second pumping system 100 can be replaced with third and subsequent pumping systems 100 if changes in the quantity or quality of fluids produced by the well 200 justify the replacement.

Figure 9:
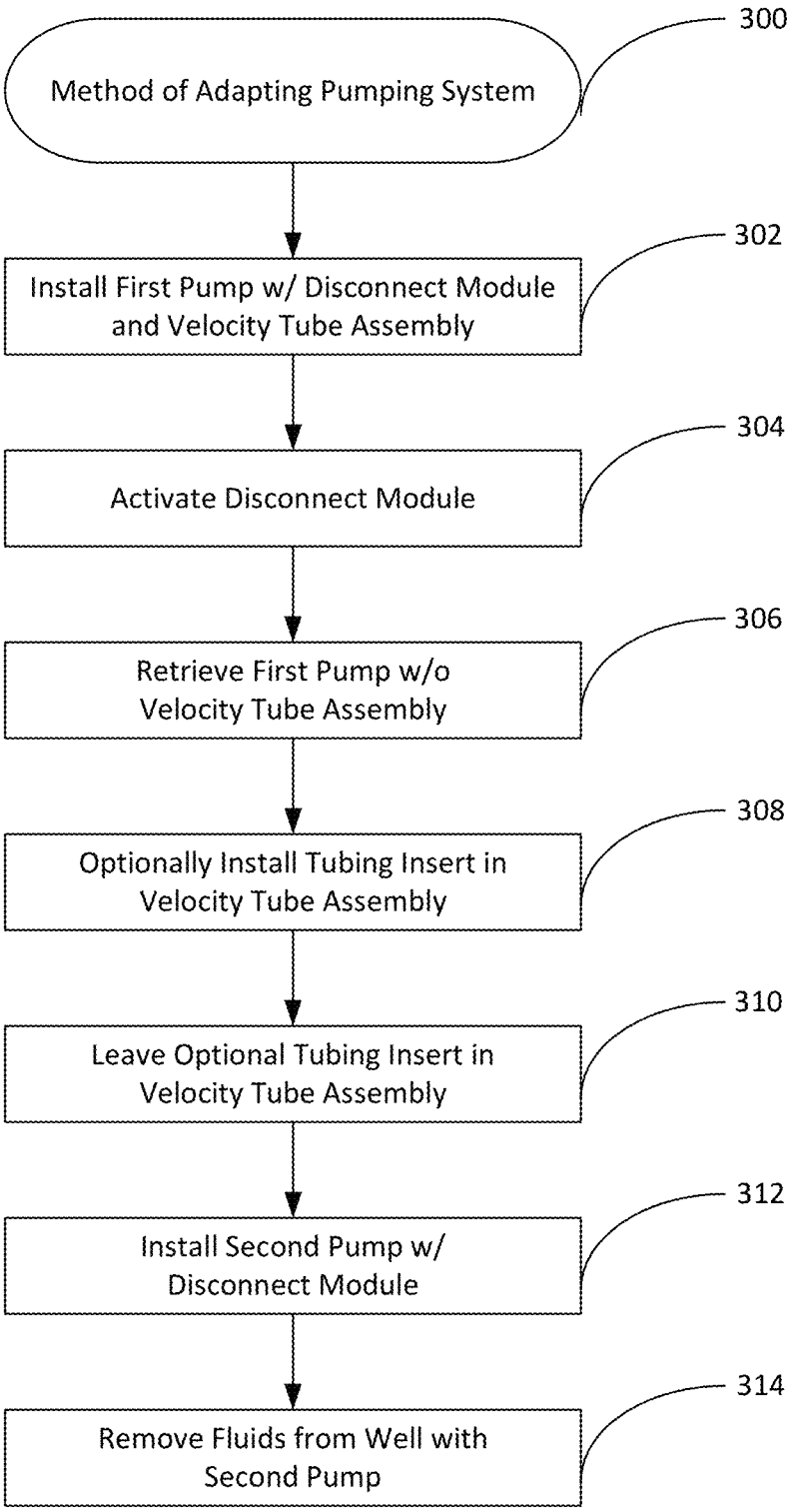
FIG. 9 is a process flow chart for a method of adapting a pumping system to meet changing production volumes in a well.

In this way, embodiments of the present invention also include a method 300 for adapting a pumping system 100 in response to changes in production volumes in a well 200. Turning to FIG. 9, shown therein is a flow chart for the method 300 that begins at step 302 by installing a pumping system 100 into the well 200 that includes a first pump 146. The first pump 146 can be an electric submersible pump, a downhole reciprocating pump, a progressive cavity pump, or another pump type. The first pump 146 can be is installed in the well 200 together with the velocity tube assembly 104 and the disconnect module 140. The first pump 146 is operated within the pumping system 100 until the conditions in the well 200 support a decision to replace the first pump 146.

At step 304, the disconnect module 140 is activated to separate the first pump 146 from the velocity tube assembly 104. The first pump 146 can then be removed from the well 200 at step 306, together with any intervening equipment, such as a multiphase diverter 106. After the first pump 146 has been removed, a tubing insert 142 can optionally be installed within the velocity tube assembly 104 at step 308. At step 310, the tubing insert 142 is severed and the portion above the velocity tube assembly 104 is retrieved from the well, leaving the remaining tubing insert 142 inside the velocity tube assembly 104 to provide a smaller annular space within the velocity string 120 to increase the velocity of fluids passing from the perforations 212 to the second pump 148.

Next, at step 312, the second pump 148 is installed in the well and connected directly or indirectly to the velocity tube assembly 104. The second pump 148 can be installed together with the disconnect module 140 to the top of the velocity tube assembly 104. The second pump 148 can be an electric submersible pump, a downhole reciprocating pump, a progressive cavity pump, or another pump type. Once the second pump 148 is installed, the pumping system 100 can be activated to remove fluids from the well 200 at step 314.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pumping system configured to be deployed in a well that has a vertical portion and a lateral portion to recover wellbore fluids, wherein the pumping system comprises:
- a pump positioned in the vertical portion, wherein the pump comprises:
  - a shroud that includes an open upper end and a closed bottom; and
  - an intake inside the shroud;
- a velocity tube assembly that extends from the vertical portion into the lateral portion; and
- a multiphase diverter connected between the pump and the velocity tube assembly,
  - wherein the multiphase diverter comprises:
  - a housing;
  - a plurality of ejection ports that extend through the housing at a downward angle; and
  - a closed joint connected to the closed bottom of the shroud, wherein the closed joint forces wellbore fluids to be ejected through the ejection ports.

2. The pumping system of claim 1, wherein a first number of the plurality of ejection ports extend through the housing at an angle of between about 95° and about 175° from a vertical reference axis passing through the multiphase diverter.

3. The pumping system of claim 1, wherein a first number of the plurality of ejection ports extend through the housing at an angle of greater than about 1100 from a vertical reference axis passing through the multiphase diverter.

4. The pumping system of claim 1, wherein the shroud comprises a shroud hanger.

5. The pumping system of claim 4, wherein the shroud has an outer diameter, the well has a casing with an inner diameter, and an external annular space between the outer diameter of the shroud and the inner diameter of the well casing creates a clearance that has a cross-sectional width that is between about 2.5% to about 12% of the outer diameter of the well casing.

6. The pumping system of claim 4, wherein the pump is an electric submersible pump that comprises:
- a motor contained within the shroud; and
- a pump contained within the shroud, wherein the pump is driven by the motor.

7. The pumping system of claim 4, wherein the pump is a reciprocating pump that includes an intake tube that extends into the shroud.

8. The pumping system of claim 1, wherein the velocity tube assembly comprises:
- a velocity string;
- an inlet joint; and
- a packer system between the velocity string and the inlet joint.

9. The pumping system of claim 8, wherein the inlet joint further comprises solid exclusion devices configured to reduce the amount of proppant or other solids drawn into the velocity string.

10. The pumping system of claim 1, wherein the velocity tube assembly further comprises a cleanout tool that is configured to wash solid particles away from the velocity tube assembly.

11. The pumping system of claim 10, wherein the cleanout tool is activated in response to a mechanism selected from the group of mechanisms consisting of a dropped ball, a dropped dart, and a remote activation signal from the surface.

12. The pumping system of claim 11, wherein the remote activation signal is selected from the group of signals consisting of wireless, wired and mechanical signals.

13. The pumping system of claim 11, wherein the remote activation signal is selected from the group of signals consisting of acoustic, electric, electromagnetic, RFID, chemical and mechanical signals.

14. A pumping system configured to be deployed in a well that has a vertical portion and a lateral portion, wherein the pumping system comprises:
- an electric submersible pump positioned in the vertical portion, wherein the pump comprises:
  - a shroud that has an open upper end, a closed bottom, and a shroud hanger;
  - an electric motor; and
  - a centrifugal pump driven by the electric motor, wherein the centrifugal pump includes an intake located within the shroud;
- a velocity tube assembly that extends from the vertical portion into the lateral portion;
- a multiphase diverter, wherein the multiphase diverter comprises:
  - a housing;
  - a closed joint connected between the housing and the closed bottom of the shroud;
  - a plurality of ejection ports that extend through the housing at a downward angle; and
- a disconnect module positioned between the multiphase diverter and the velocity tube assembly to permit the removal of the electric submersible pump and multiphase diverter from the velocity string.

15. The pumping system of claim 14, wherein the motor is contained inside the shroud.

16. The pumping system of claim 14, wherein the motor is positioned outside the shroud.

17. The pumping system of claim 14, wherein the velocity tube assembly further comprises:
- a string; and
- a tubing insert within the velocity string.

18. The pumping system of claim 17, wherein the tubing insert comprises a portion of coiled tubing installed within the velocity string.

19. A method for optimizing the production of hydrocarbons from a well comprising the steps of:
- installing a pumping system in the well, wherein the pumping system includes a first pump, a velocity tube assembly and a disconnect module between the first pump and the velocity tube assembly;
- operating the pumping system with the first pump to remove hydrocarbons from the well;
- activating the disconnect module to separate the first pump from the velocity tube assembly;
- removing the first pump from the well;
- installing a second pump into the well and connecting the second pump to the velocity tube assembly with the disconnect module; and
- operating the pumping system with the second pump to remove hydrocarbons from the well.

20. The method of claim 19, further comprising the step of installing a tubing insert into the velocity tube assembly between the steps of removing the first pump from the well and installing the second pump in the well.

* * * * *